United States Patent [19]

Kitagawa

[11] Patent Number: 4,502,187

[45] Date of Patent: Mar. 5, 1985

[54] BANDS FOR CLAMPING

[75] Inventor: Hiroji Kitagawa, Nagoya, Japan

[73] Assignee: Kitagawa Industries Co., Ltd., Nagoya, Japan

[21] Appl. No.: 457,073

[22] PCT Filed: May 11, 1981

[86] PCT No.: PCT/JP81/00108

§ 371 Date: Jan. 5, 1983

§ 102(e) Date: Jan. 5, 1983

[87] PCT Pub. No.: WO82/04030

PCT Pub. Date: Nov. 25, 1982

[51] Int. Cl.[3] ..... B65D 63/00

[52] U.S. Cl. ..... 24/16 PB; 24/17 AP; 24/30.5 P

[58] Field of Search ..... 24/16 PB, 17 AP, 30.5 P; 248/74.5

[56] References Cited

U.S. PATENT DOCUMENTS

| | | | |
|---|---|---|---|
| 3,149,808 | 9/1964 | Weckesser | 248/74.5 |
| 3,214,808 | 11/1965 | Litwin | 24/16 PB |
| 3,900,922 | 8/1975 | McCormick | 24/16 PB |
| 3,906,593 | 9/1975 | Caveney et al. | 24/16 PB |
| 3,908,233 | 9/1975 | Caveney et al. | 24/16 PB |
| 3,949,449 | 4/1976 | Caveney et al. | 24/16 PB |

FOREIGN PATENT DOCUMENTS

| | | | |
|---|---|---|---|
| 993631 | 7/1976 | Canada | 24/16 PB |
| 41747 | 1/1941 | Japan . | |
| 47-7286 | 9/1972 | Japan . | |
| 48-19396 | 3/1973 | Japan . | |
| 51-4586 | 1/1976 | Japan . | |
| 53-57084 | 5/1978 | Japan . | |
| 53-163671 | 12/1978 | Japan . | |
| 54-67188 | 5/1979 | Japan . | |

*Primary Examiner*—Victor N. Sakran

*Attorney, Agent, or Firm*—Oblon, Fisher, Spivak, McClelland & Maier

[57] ABSTRACT

A band for clamping produced by integrally molding a synthetic resin, such as nylon etc., and having a structure in which each tooth tip (9*a*) is formed so that the angle ($\theta$) formed by one side surface (10), i.e. the surface to be engaged with the engaging portion (8*a*) at the tip of the small lip portion (8) and the surface (2*a*) of the strap-like tongue (2) is an acute angle and each tooth tip (9*a*) of these is adopted for being engaged with the engagement portion (8*a*) at the tip of the small lip portion (8). Therefore, the engagement is more securely effected and free from a danger of loosening of the tight binding due to slip-off during use.

15 Claims, 9 Drawing Figures

(A)

(B)

BANDS FOR CLAMPING

TECHNICAL FIELD

This invention relates to bands for clamping having a wide range of applications, for example, for gathering objects of continuous lengths such as electrical wires, pipings, bar-shaped iron materials etc., for tightening open parts of sacks and so forth.

BACKGROUND ART

Objects of continuous lengths, such as electrical wires arranged in electrical appliances, pipings, bar-shaped iron materials for construction works etc., are put in order by tying a plural number of thereof into each bundle using bands for clamping. Further, bands for clamping are also employed instead of the conventional tying strings in the case, e.g where open parts of sacks are closed after filling the contents.

As for bands for clamping, various forms have heretofore been proposed. As one of those, there is known such structure that comprises a band for tying to objects of continuous lengths or open parts of sacks and a head integrally formed therewith and having at one end of the band a hole for inserting the other end of the band, which structure is made of a flexible metal or plastic material, and which is further provided with engaging teeth on the band and either an engaging tongue having a teeth surface to be engaged with the above-described engaging teeth of the band provided on the inner surface of the insertion hole of the head or an engaging tongue to be engaged with the above-described engaging teeth on the exit surface of the insertion hole, so that the other end of the band is passed through the above-described insertion hole to form a loop, thereby tying the objects of continuous lengths into a bundle. However, with the conventional bands for clamping, for example, in a structure, as llustrated in FIGS. 1 A and B, in which a band (2) having engaging teeth (9) and a head (1) having an engaging protrusion (8) on the exit surface (5) of an insertion hole (6) are jointly provided, since the angle ($\theta$) formed by an engaging surface (10) at one tooth tip (9*a* ) of the above-described engaging teeth and the surface (2*a*) of the band is often a right angle or larger, this has a disadvantage that the engagement between the above-described engaging protrusion (8) and said tooth tip (9*a*) of the engaging teeth (9) easily comes off and thus that even though objects of continuous lengths or the like (11) have been tightly tied into a bundle, it comes off and becomes useless. Furthermore, since the band (2) is jointly provided with the head (1), flexibility is poor and hence there is only little freedom for the up-and-down flexing motion of the head (1), it also had a disadvantage that, for instance, when tying a great number of objects of continuous lengths, the engagement of the tooth tip (9*a*) of the above-described engaging teeth (9) and the engaging protrusion (8) even more easily comes off.

As the result of our intensive study in order to find bands for clamping for objects of continuous lengths which have eliminated the disadvantages found with the conventional bands for clamping, it has now been discovered that by providing the tooth tips of the engaging teeth in the above-described band in a specific form and at the same time rendering flexibility by imparting improvement to the joint part between the band and the head, a clamping device having good tying properties can be obtained and accordingly this invention has been accomplished.

DISCLOSURE OF THE INVENTION

Accordingly, this invention resides in a band for clamping for use in the form of a loop which is characterized by comprising an elongate, flexible strap-like tongue having engaging teeth provided on the surface of one side in the transverse direction, a wide, thin joint portion of a certain length formed at the end of said strap-like tongue, and a head formed integrally with said tongue via said portion and provided with a hole for inserting the other end of the strap-like tongue. The hole is larger than the width of said tongue but smaller than the width of said joint portion. Each tooth tip of the above-described engaging teeth has a flat pointed end and has been cut into a shape in such way that the angle formed by the surface of the strap-like tongue on which the engaging teeth are provided and the tooth tip engaging surface will be an acute angle so as to give a checking effect when inserting the other end of the strap-like tongue through the insertion hole of the head. The above-described head has a large lip portion and a flexible small lip portion so as to surround the exit surface of the insertion hole. Furthermore, said small lip portion is provided on its tip with an engaging portion which will bend and become engaged with the engaging surface tip of the above-described engaging teeth on the inserted strap-like tongue so as to plug the exit surface of the above-described insertion hole.

BRIEF DESCRIPTION OF THE DRAWING

FIGS. 2–7 are figures showing one example of this invention, wherein FIG. 2 is its general side view, FIG. 3 is its general plan view, FIG. 4 is its general bottom view, FIG. 5 is its partially enlargened vertical cross-sectional view showing the head portion, A of FIG. 6 is its partially enlargened vertical cross-sectional view showing the head portion in the state of use, B is the partially enlargened side view of the strap-like tongue, and FIG. 7 is its general side view showing the state of use.

BEST MODE OF CARRYING OUT THE INVENTION

Figure 1A:
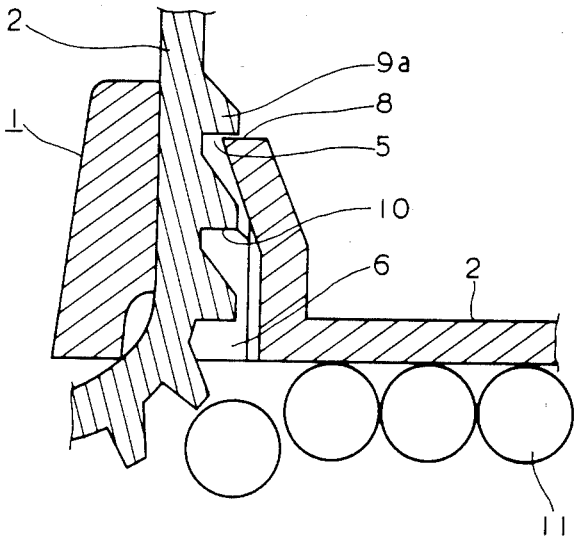
Fig. 1A PRIOR ART
FIG. 1 is a figure showing a structure of a conventional clamping band, wherein A is an enlarged cross-sectional view of a head, and B is a partially enlargened side view of the band.
Figure 1B:
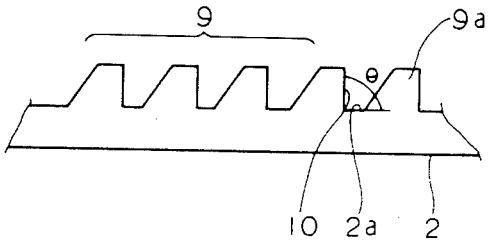
Fig. 1B PRIOR ART
Figure 2:
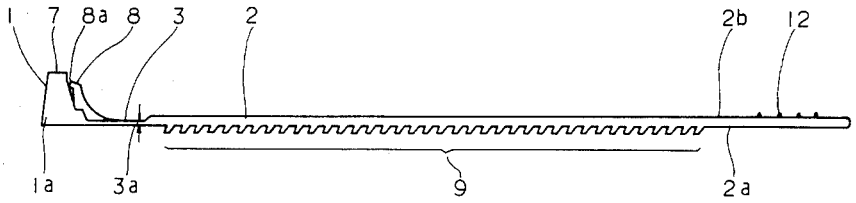
Figure 3:
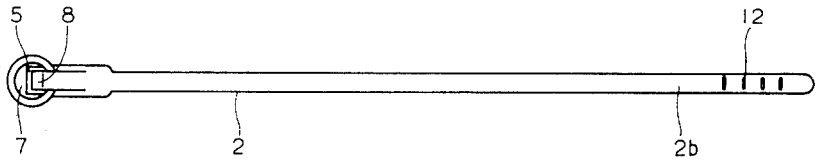
Figure 4:
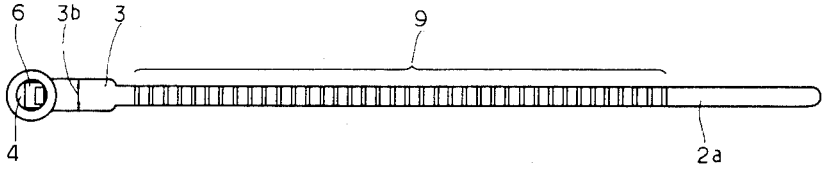
Figure 5:
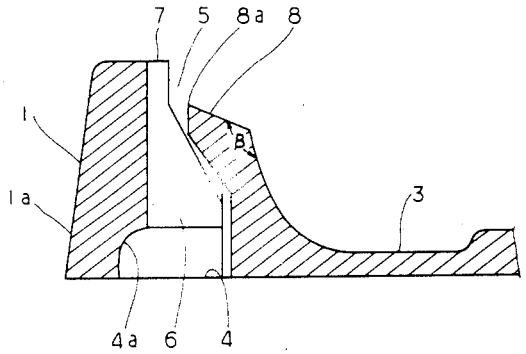

The band for clamping of this invention is integrally formed using a synthetic resin such as nylon etc. as the material, and FIG. 2 illustrates its general side view, FIG. 3 its general plan view and FIG. 4 its general bottom view. In the figures, (1) is a head and (2) is an elongate strap-like tongue, both of which are integrally formed with each other by a thin joint portion (3) at one end of the strap-like tongue (2) and the joint portion (3) is imparted with high strength against pulling force and flexibility by making the thickness (3*a*) thereof about $\frac{1}{2}$ time that of the strap-like tongue (2) and at the same time making the width (3*b*) thereof in the transverse direction about 2 times.

Figure 6:
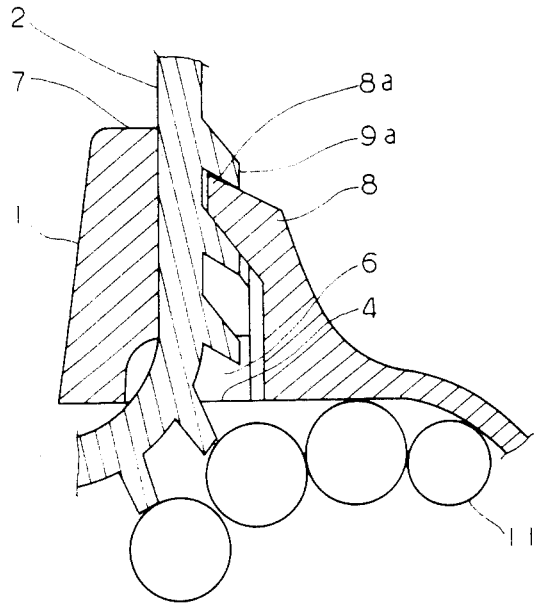
Figure 6:
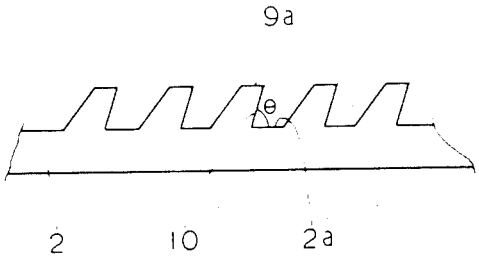
Figure 7:
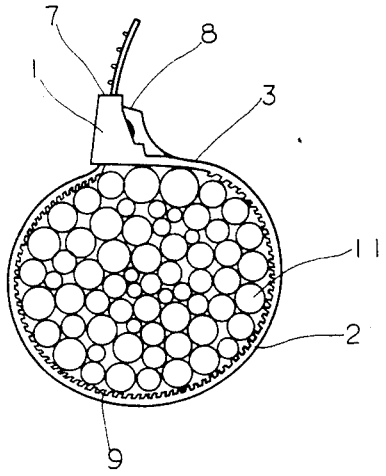

By forming the joint portion (3) as described above, the flexing properties between the head (1) and the strap-like tongue (2) are retained and therefore clamping of objects of continuous lengths larger than the width of the joint portion (3) is facilitated. The head (1) has a base portion (1*a*) in a conical shape having a rigid, thick structure and is provided on the same surface as one side surface (2*b*) of the strap-like tongue (2). Provided on this are an entrance surface (4) and an exit surface (5), and around the entrance surface (4) is provided a structure having a rectangular transverse cross-section with a cut-out recess (4*a*). An insertion hole (6) having a size about enough for inserting the strap-like tongue (2) and having a length more than that of the joint portion (3) is provided thereon. At the exit surface (5), its tip shape is modified, and surroundingly provided are a large lip portion (7) having a rigid, thick structure and a small lip portion (8) having somewhat flexibility itself, both portions being formed opposite to each other, and the tip of the small lip portion (8) is provided with an engaging portion (8*a*) which will be bent inside to form an oblique angle ($\beta$) so as to plug the exit surface (5) of the insertion hole (6), said engaging portion being formed in such way that it will be interlocked with the hereinbelow described engaging teeth cut out on the strap-like tongue (2) when the other end of the strap-like tongue (2) is inserted through the insertion hole (6). (9) is the above-mentioned engaging teeth, which are provided in a great number in the direction transversing the longitudinal direction of the strap-like tongue (2) on the surface (2*a*) opposite to said one side surface (2*b*) of the strap-like tongue (2), that is, the surface opposite to the surface of the exit surface (5) of the insertion hole (6) on which the large lip portion (7) and the small lip portion (8) are provided, and this functions to engage with the engaging portion (8*a*) at the tip of the small lip portion (8) as described above. Further, the engaging teeth (9) are provided in such way that each tooth tip (9*a*) protrudes from the surface (2*a*) of the strap-like tongue (2), as shown in FIG. 7, so as to fix a material to be clamped, such as objects of continuous lengths, without causing any slippage between said objects of continuous lengths and the strap-like tongue (2) when clamping them by inserting the other end of the strap-like tongue (2) into the insertion hole (6) of the above-described head (1). Furthermore, as shown in FIG. 6B, each tooth tip (9*a*) of the engaging teeth (9) has a flat pointed end, and the angle ($\theta$) formed by the engaging surface (10) and the surface (2*a*) of the strap-like tongue (2) is an acute angle. By adopting such a structure, as illustrated in FIG. 6A, when clamping objects (11) of continuous length, for example, electrical wires, the engagement is securely effected by the checking effect caused by the clamping in the engagement with the engaging portion (8*a*) which is pressed into engagement with the engaging surface (10) of the engaging teeth (9) and the surface (2*a*) of the strap-like tongue (2). Therefore it is free from loosening, unlike the case with the conventional product, where the above-described angle is 90° or larger and hence the engagement between the engaging teeth and the engaging portion comes off and its tight binding is loosened; such a structure is one of the great features of this invention. In this connection, the above-described angle ($\theta$) may satisfactorily be slightly less than 90°, and is sufficient in the range of 85°–80°.

(12) is a plurality of holding protrusions provided protrudingly in a plurality of lines in the transverse direction of the surface (2*a*) on which the engaging teeth (9) are not provided in the vicinity of the other end of the strap-like tongue (2), and they are provided merely for the purpose of preventing slipage when pulling the strap-like tongue (2) by fingers on inserting the other end thereof through the insertion hole (6) of the above-described head (1) and can be adopted according to the necessity.

By the partially enlarged view of FIG. 6A and the general view of FIG. 7, the state where objects of continuous length are tightly bound using a band for clamping is illustrated.

In other words, by tying the material to be clamped, for example, objects of continuous lengths (11) etc., with the strap-like tongue (2) on the side where the engaging teeth (9) are provided, passing the end part through the insertion hole (6) of the head, and then pulling said end part at the exit surface (5), to make a loop, the engaging portion (8*a*) at the tip of the above-described small lip portion (8) is interlocked with the teeth of the engaging teeth (9) and further the angle formed by the engaging surface of the tooth tip (9*a*) and the surface of the strap-like tongue does not exceed 90°, and therefore the engagement is more securely effected and does not result in loosening of the tight binding due to slip-off during use.

As the above-described invention enploys an elongated flexible joint portion 3 which bends in accordance with the size of objects to be clamped, the invention is particularly well adapted to get good engagement between the engaging portion 8*a* of the small lip portion 8 and the engaging teeth 9.

Moreover, the joint portin 3 is composed of a certain length of thin plate having a width larger than that of the strap-like tongue 2. Therefore, the clamping band of the present invention clamps only objects the periphery of which is more than the length of the joint portion 3, thereby uniformly imparting all the strength with all length of the tongue. For that reason, the objects to be clamped are not damaged, as strong pressure does not act on one particular side of the objects.

Moreover, the elongated joint portion 3 enables the dispersion of the strong pulling strength and the bending strength to a wide range of the joint portion, and the stress on it is made as little as possible. Accordingly, the joint portion 3 is highly durable.

Moreover, the engagement cannot become bad, in spite of repeated use, as each engaging tooth (9) formed on the strap-like tongue (2) has a flat and not sharp pointed end, the small lip-portion 8 and large lip-portion 7 of the exit surface 5 provided on the head 1 are formed separately, and only the small lip-portion 8 has flexibility.

An engaging portion (8*a*) is bent downwardly in the same direction as the inserting direction of the strap-like tongue 2 at the exit surface of the small lip-portion 8, and the engaging portion 8*a* consists of two surfaces which are pressed into engagement with the engaging surface 10 of the engaging teeth 9 and the surface 2*a*, the two of which are deeply engaged with the engaging teeth 9 to prevent the untying movement which is opposite to the inserting direction of the strap-like tongue 2.

INDUSTRIAL APPLICABILITY

As has been described above, the present invention is of a structure in which the joint part between the head and the strap-like tongue is imparted with flexing strength while the engaging teeth are formed in specific shapes so that the engagement does not easily come off, and accordingly it is very convenient as material for putting in order such materials as pipings, iron materials etc. for construction works, as well as for gathering wirings in electrical appliances.

I claim:

1. A clamping band for use in the form of loop, said clamping band comprising:

(a) an elongated, flexible, strap-like tongue having uniform width and thickness over its length;

(b) engaging teeth provided on the surface of one side of said tongue and having engaging surfaces on one side thereof and trailing surfaces on the other side thereof, said engaging surfaces and said trailing surfaces both extending in the transverse direction of said tongue;

(c) a joint portion formed integrally at one end of said tongue, said joint portion being approximately half as thick and twice as wide as said tongue;

(d) a plurality of holding protrusions on the opposite side of said tongue from said engaging teeth near the end of said tongue remote from said joint portion;

(e) a head formed integrally at the end of said joint portion remote from said tongue, said head having an entrance surface coplanar with one surface of said joint portion and an exit surface remote from said entrance surface;

(f) said head having a generally conical shape extending perpendicularly from said entrance surface in the opposite direction from said engaging teeth and having a rigid, thick structure;

(g) said head having an insertion hole extending therethrough from its entrance surface to its exit surface, said insertion hole being sized to receive said tongue and said engaging teeth;

(h) the angle between the engaging surfaces of said engaging teeth and the surface of said tongue being a first acute angle;

(i) a small, flexible lip portion formed integrally on said head on the internal surface of said insertion hole in position to fit between two adjacent ones of said engaging teeth and to bear against the engaging surface of one of said two adjacent ones of said engaging teeth and the trailing surface of the other of said two adjacent ones of said engaging teeth, said small lip having opposing surfaces which are angled towards each other in the direction from the base to the top of said small lip by a third acute angle at least approximately equal to the difference between said first and second acute angles, whereby said small lip makes at least approximately planar engagement with the engaging surface of one of said two adjacent ones of said engaging teeth and the trailing surface of the other of said two adjacent ones of said engaging teeth; and (j) said small lip, said insertion hole, said tongue, and said engaging teeth being sized such that if, after said small lip has become engaged between two adjacent ones of said engaging teeth, an attempt is made to pull said tongue out of said insertion hole in the reverse direction, said lip will flex inwardly in said insertion hole, jamming the opposite side of said tongue from said engaging teeth against the opposite side of said insertion hole from said small lip, preventing withdrawal of said tongue from said insertion hole.

2. A clamping band as recited in claim 1 wherein said entrance surface is provided with a structure having a rectangular transverse cross-section with a cut-out recess.

3. A clamping band as recited in claim 1 wherein said insertion hole has cut-out recess at said entrance surface, said cut-out recess extending in the direction from which said tongue is inserted during use of the clamping band and permitting said tongue to curve gradually away from said insertion hole.

4. A clamping band as recited in claim 1 wherein said engaging teeth are provided on substantially the entire length of said tongue, whereby said engaging teeth also serve to prevent slippage between said tongue and objects being held by the clamping band.

5. A clamping band as recited in claim 1 wherein the angle between the engaging surfaces of said engaging teeth and the surface of said tongue is between 80° and 85°.

6. A clamping band as recited in claim 1 wherein the angle between the trailing surfaces of said engaging teeth and the surface of said tongue is a second acute angle which is less than the acute angle between the engaging surfaces of said engaging teeth and the surface of said tongue.

7. A clamping band for use in the form of a loop comprising:

(a) a long strap of flexible strap-like tongue;

(b) engaging teeth provided on one side surface of said tongue and extending in the transverse direction of said tongue;

(c) a joint portion formed to have a certain length larger than the width of said tongue at the end of said tongue;

(d) a head equipped with an insertion hole which is larger than said tongue and which is smaller than the width of said joint portion, capable of inserting the end of the strap-like tongue which is integrally formed on said joint portion;

(e) each tooth tip of said engaging teeth having a flat pointed end and being formed to have an acute angle made by an engaging surface of the tooth tip and a surface of the strap-like tongue to provide a checking effect when said strap-like tongue is inserted into the insertion hole of said head; and (f) a large lip-portion and a flexible small lip-portion formed to surround an exit surface of the insertion hole, (g) an engaging portion being formed at the top of said small lip-portion, said engaging portion being engaged to said surface end and engaging surface of each tooth of said strap-like tongue which is wrenched to close the exit surface of said insertion hole.

8. A clamping band recited in claim 7 wherein said engaging teeth are formed on the full length of the strap-like tongue except for its end.

9. A clamping band as recited in claim 7 wherein said joint portion has a thickness of half as thick as said tongue, and a width two times as wide as said tongue.

10. A clamping band as recited in claim 7 wherein the engaging portion comprises a surface which is vertical to the entrance surface at the tip of the small lip portion and two surfaces which are engaged to the engaging surface and the surface of said tongue, the angle between said two surfaces being acute.

11. A clamping band as recited in claim 7 wherein said portion is structured by hard thick wall and is in conical shape, formed to have the entrance surface, the exit surface, and the insertion hole to insert the end of said strap-like tongue.

12. A clamping band as recited in claim 11 wherein a rigid thick structure of large lip portion, at said exit surface of the top of which faced to small lip portion is different in shape from the other part of large lip portion and it looks like to surround the exit surface.

13. A clamping band as recited in claim 12 wherein said large lip portion is formed to face said small lip portion.

14. A clamping band as recited in claim 7 wherein said angle between said engaging surface of said engaging teeth and said surface of said tongue is between 80° and 85°.

15. A clamping band as recited in claim 13 wherein said entrance surface is provided with a structure having a rectangular cross-section with a cut-out recess.

* * * * *